US010464788B1

(12) United States Patent
Bonifas

(10) Patent No.: US 10,464,788 B1
(45) Date of Patent: Nov. 5, 2019

(54) PORTABLE HOISTING SYSTEM

(71) Applicant: Guy Elli Bonifas, Montgomery, AL (US)

(72) Inventor: Guy Elli Bonifas, Montgomery, AL (US)

( * ) Notice: Subject to any disclaimer, the term of this patent is extended or adjusted under 35 U.S.C. 154(b) by 182 days.

(21) Appl. No.: 15/812,734

(22) Filed: Nov. 14, 2017

(51) Int. Cl.

| | |
|---|---|
| ***B66C 23/20*** | (2006.01) |
| ***B66C 23/48*** | (2006.01) |
| ***B66C 23/34*** | (2006.01) |
| *B66C 23/92* | (2006.01) |

(52) U.S. Cl.
CPC ..... *B66C 23/203* (2013.01); *B66C 23/342* (2013.01); *B66C 23/48* (2013.01); *B66C 23/92* (2013.01)

(58) Field of Classification Search
CPC ..... B66C 23/022; B66C 23/027; B66C 23/10; B66C 23/166; B66C 23/203; B66C 23/42; B66C 23/46; B66C 23/66; B66C 23/68
See application file for complete search history.

(56) References Cited

U.S. PATENT DOCUMENTS 1,540,630 A 6/1925 Jenks et al.
1,955,259 A 4/1934 Streeter
2,309,769 A * 2/1943 Hubbard ..... B66C 23/203 24/279
2,625,371 A * 1/1953 Dunn ..... B66C 23/203 248/230.8
2,833,423 A * 5/1958 Tucker ..... B66C 23/203 212/179
3,037,641 A 6/1962 Potter et al.
3,050,285 A * 8/1962 Troyer ..... B66C 23/36 254/285
3,084,808 A * 4/1963 Peduzzi ..... B66C 23/48 212/284
3,148,778 A * 9/1964 Fox ..... B66C 23/60 212/240
3,165,297 A * 1/1965 Thompson, III ..... B66D 1/12 254/344
3,978,989 A * 9/1976 Avila, Jr. ..... B66C 23/205 212/176
4,560,074 A 12/1985 Manning
4,684,031 A 10/1987 Bergman et al.
(Continued)

*Primary Examiner* — Emmanuel M Marcelo
(74) *Attorney, Agent, or Firm* — George L Williamson

(57) ABSTRACT

Method and apparatus for a portable hoisting system having an upright gin pole which is attached to the upright standing very tall pole or tower using a plurality of straps. Extending away from the gin pole is an angularly adjustable arm which is user selectable to be either; e.g., at a 90-degree angle or a 45-degree angle, which arm is supported by a brace connected between the extension arm and the upright gin pole. The gin pole is hollow on its inside which allows a load line to travel through the interior of the gin pole from its lower end to its upper outlet end and includes a plurality of pulleys which allow the load line to travel through the inside of the hoisting system. Also included is a heel block or the like wherein one end of the load line is connected to a capstand hoist disposed on the front or rear end of a vehicle and a ball with hook for supporting a load. Also included optionally is a tag line connected to the load line and being held by a ground member for helping to control the movement of the load.

18 Claims, 3 Drawing Sheets

(56) References Cited

U.S. PATENT DOCUMENTS

| | | | | | |
|---|---|---|---|---|---|
| 5,056,673 | A * | 10/1991 | Williams | B66C 23/203 | 212/179 |
| 5,820,455 | A * | 10/1998 | Breedlove | A22B 5/06 | 452/187 |
| 6,138,991 | A * | 10/2000 | Myers, Jr. | B66C 23/44 | 212/180 |
| 6,695,688 | B1 * | 2/2004 | Owen | A22B 5/06 | 452/185 |
| 6,983,856 | B1 | 1/2006 | Burks | | |
| 7,913,980 | B1 * | 3/2011 | Cipriano | B66D 3/08 | 248/218.4 |
| 9,282,752 | B1 * | 3/2016 | Wylie | A22B 5/161 | |
| 2003/0228838 | A1 * | 12/2003 | Gearhart | A22B 5/06 | 452/187 |
| 2006/0196435 | A1 * | 9/2006 | Bilinovich | A01K 5/00 | 119/57.91 |
| 2007/0089932 | A1 * | 4/2007 | Boyett | A01M 31/02 | 182/133 |
| 2009/0272709 | A1 * | 11/2009 | Nessner | B66C 13/04 | 212/270 |
| 2011/0049315 | A1 * | 3/2011 | Buckbee | A01K 97/00 | 248/219.4 |
| 2011/0108787 | A1 * | 5/2011 | Thomas | B66C 23/203 | 254/393 |
| 2014/0264213 | A1 * | 9/2014 | Nipper | B66C 23/203 | 254/390 |
| 2016/0024843 | A1 * | 1/2016 | Niemela | E06C 7/188 | 182/129 |

* cited by examiner

PORTABLE HOISTING SYSTEM

BACKGROUND OF THE INVENTION

Field of the Invention

The present invention relates generally to hoisting systems and, more particularly, is concerned with a portable hoisting system for use on very tall poles and towers.

Description of the Related Art

Devices relevant to the present invention have been described in the related art, however, none of the related art devices disclose the unique features of the present invention.

In U.S. Pat. No. 4,560,074 dated Dec. 24, 1985, Manning disclosed a scaffold mounted hoist. In U.S. Pat. No. 1,955,259 dated Apr. 17, 1934, Streeter disclosed a pole-type portable transformer hoist. In U.S. Pat. No. 5,056,673 dated Oct. 15, 1991, Williams disclosed a gin for electrical equipment. In U.S. Pat. No. 4,684,031 dated Oct. 4, 1987, Bergman, et al., disclosed a material hoisting gin. In U.S. Pat. No. 6,983,856 dated Jan. 10, 2006, Burks disclosed a portable crane. In U.S. Pat. No. 3,037,641 dated Jun. 5, 1962, Potter, et al., disclosed a tower crane arrangement. In U.S. Pat. No. 1,540,630 dated Jun. 2, 1925, Jenks, et al., disclosed a hoisting device.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a portable hoisting system having an upright gin pole which is attached to the upright standing very tall pole or tower using a plurality of straps. Extending away from the gin pole is an angularly adjustable arm or extension which is user selectable to be either; e.g., at a 90-degree angle or a 45-degree angle, which arm is supported by a brace connected between the extension arm and the upright gin pole. The gin pole is hollow on the inside which allows a load line to travel through the interior of the gin pole from its lower end to its upper outlet end and includes a plurality of pulleys which allow the load line to travel through the inside of the hoisting system. Also included as a part of the hoisting system is a load line attached to the lower end of the upright pole using a heel block or the like wherein one end of the load line is connected to a capstand hoist disposed on the front or rear end of a vehicle and a ball with hook for supporting a load. Also included optionally as a part of the hoisting system is a tag line connected to the load line and being held by a ground member for helping to control the movement of the load.

An object of the present invention is to provide a portable hoisting system which can be moved from one job location to another job location. A further object of the present invention is to provide a gin pole assembly which allows the load line to travel through the inside of the gin pole assembly so as to decrease friction on the load line. A further object of the present invention is to provide a hoisting system which can be easily operated by a user. A further object of the present invention is to provide a hoisting system which can be relatively inexpensively and easily manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
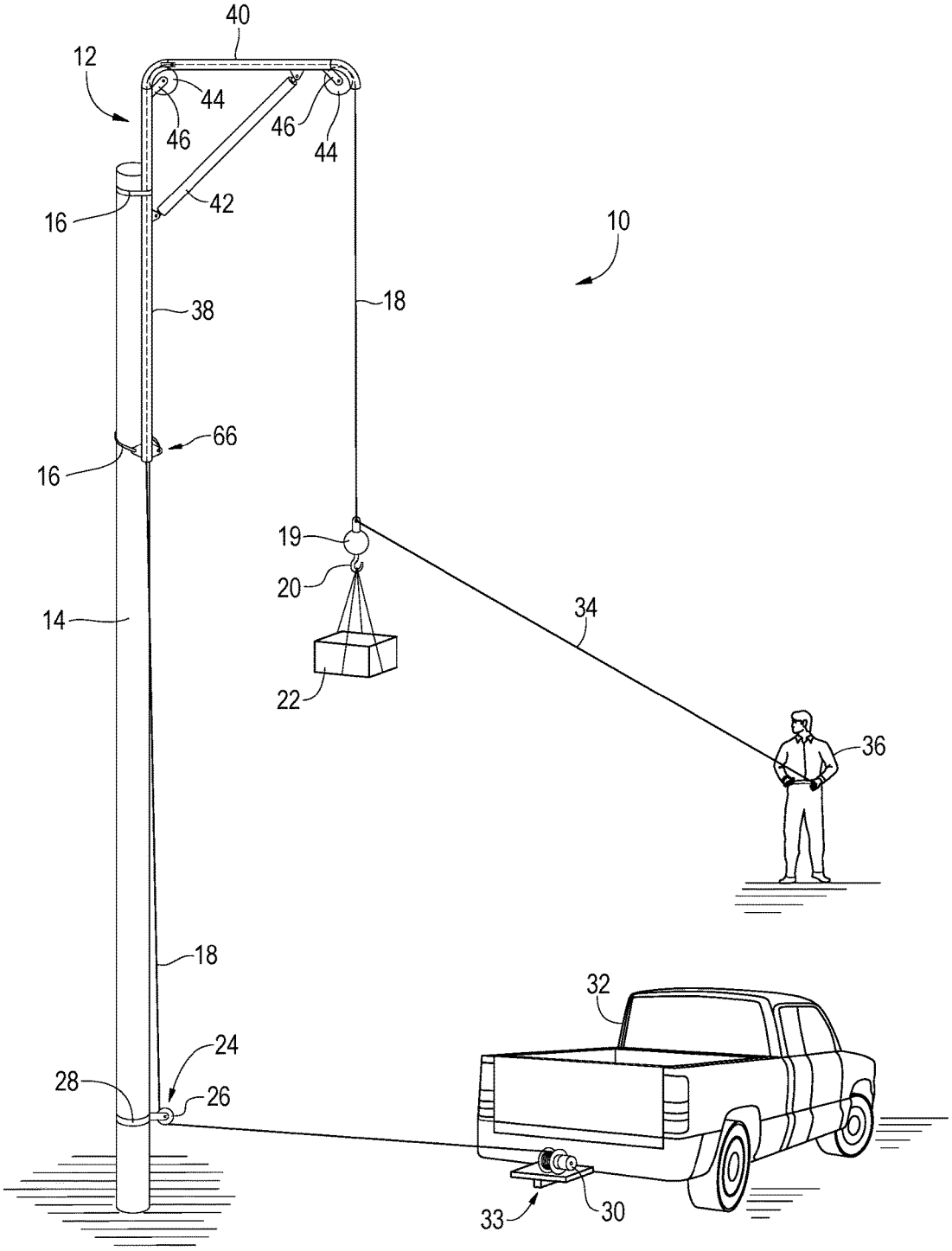
FIG. 1 is a perspective view of the present invention in operative connection.

With regard to reference numerals used, the following numbering is used throughout the drawings.

10 present invention
12 gin pole assembly
14 upright pole
tower
16 strap
18 load line
19 ball
20 hook
22 load
24 heel block
26 pulley
28 strap
30 capstan hoist
32 vehicle
33 trailer hitch
34 tag line
36 ground member
38 gin pole
40 arm
42 brace
44 pulley
46 mounting bracket
48 mount
50 pivot
52 mount
54 pivot
56 portion of pulley
58 pivoting attachment member
60 inside/interior
62 fastener
64 elbow
66 basket attachment point

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a portable hoisting system is disclosed and which is generally indicated by reference number 10.

Turning to FIG. 1, therein is shown the present invention 10 including a gin pole assembly 12 attached to a very tall upright pole or tower 14 using a plurality of straps 16 wherein a load line 18 passes through the interior of the gin pole assembly having a ball 19 and hook 20 on its lifting end for attachment to a load 22. The lower end of the load line 18 is attached to the lower end of the pole 14 using a heel block assembly 24 which includes a pulley 26 attached to the pole 14 using a strap or rope assembly 28 wherein the lower end of the load line may also be connected to a capstan hoist 30 attached to the front or rear end of a vehicle 32. A tag line 34 may be optionally connected to the ball 19 (sometimes referred to as a headache ball) which tag line is also held in the hand of a ground member 36 so that the ground member can assist in maneuvering the load 22 to, e.g., prevent the wind from blowing the load 22 into the pole/tower 14 thereby causing damage. Also shown as a part of the gin pole assembly 12 is the gin pole 38 being an upright member attached to the pole 14 using a plurality of s traps 16 and having an adjustable arm 40 extending from the gin pole through which interior of the arm the load line 18 passes and wherein the gin pole assembly 12 also includes a brace 42 having one end connected to the gin pole 38 and the other end connected to the arm 40 so as to provide support for the arm 40 which extends laterally from gin pole 38. The gin pole assembly 12 also includes a plurality of pulleys 44 which extend into the interior of the gin pole assembly and being attached to the gin pole assembly using mounting brackets 46. A basket attachment point is shown at 66.

Figure 2:
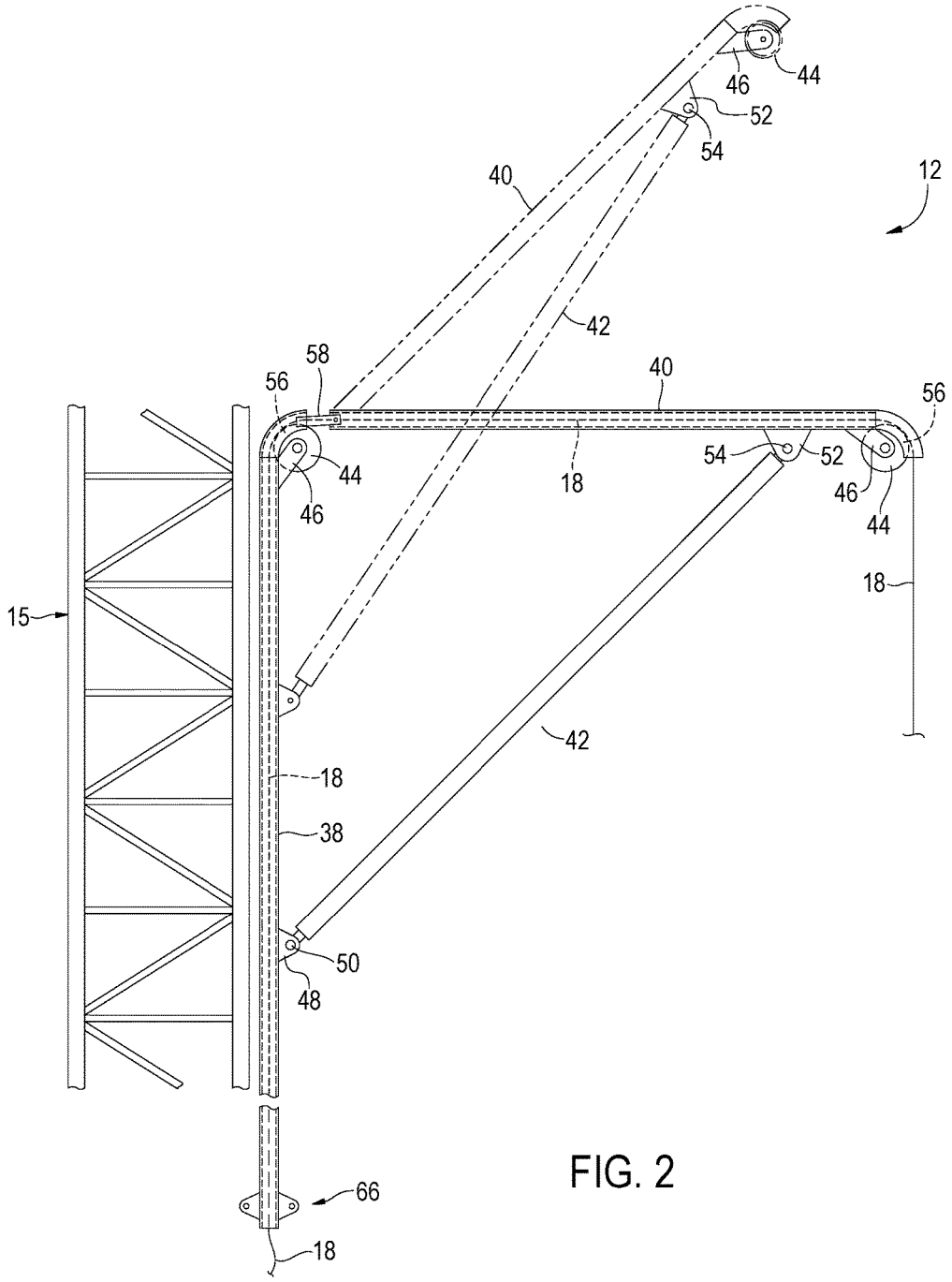
FIG. 2 is a side elevation view of the gin pole assembly of the present invention.
Figure 3:
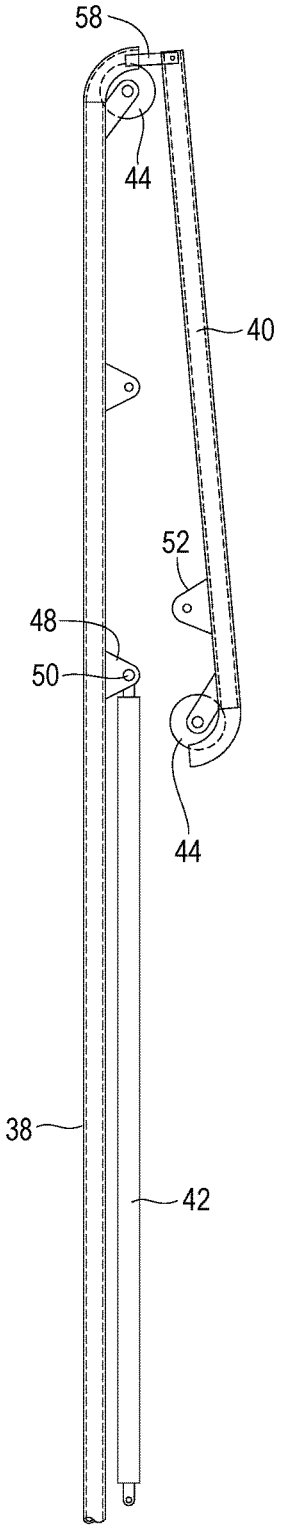
FIG. 3 is a side elevation view of the gin pole assembly of the present invention in a folded position.

Turning to FIGS. 2 and 3, therein is shown the gin pole assembly 12 with gin pole 38 and arm 40 extending laterally therefrom and including a brace 42 having a lower end mounted at 48 to the gin pole and being pivotable at 50 and showing the upper end mounted at 52 to arm 18 with a pivot point 54 thereon and also showing the arm 40 being attached on one end using a pivotal member 58 which allows the arm 40 to be angularly adjustable manually from a user selectable position perpendicular to the gin pole up to an angle of approximately 45 degrees with the gin pole as shown in FIG. 2. Also shown are the pulleys 44 with mounting brackets 46 for attachment to the gin pole wherein the pulleys have an outer peripheral portion 56 which extends into interior of the gin pole assembly 12 so that the outer periphery of the pulley 44 is approximately at the center line of the gin pole so that the load line 18 can pass through the inside of the pole 60 so that the load line travels on the inside of the gin pole assembly thereby reducing friction between the load line and the inside surface of the gin pole. Also shown are the pulleys 44 attached to the members of the gin pole assembly 12 using mounting brackets 46. The basket attachment point is shown at 66. An alternative angle of the arm 40 is shown in phantom line. FIG. 2 shows the gin pole 38 attached to a tower 15. FIG. 3 shows the gin pole assembly 12 in a folded configuration which is accomplished by disconnecting one end of the brace 42 from arm 40.

Figure 4:
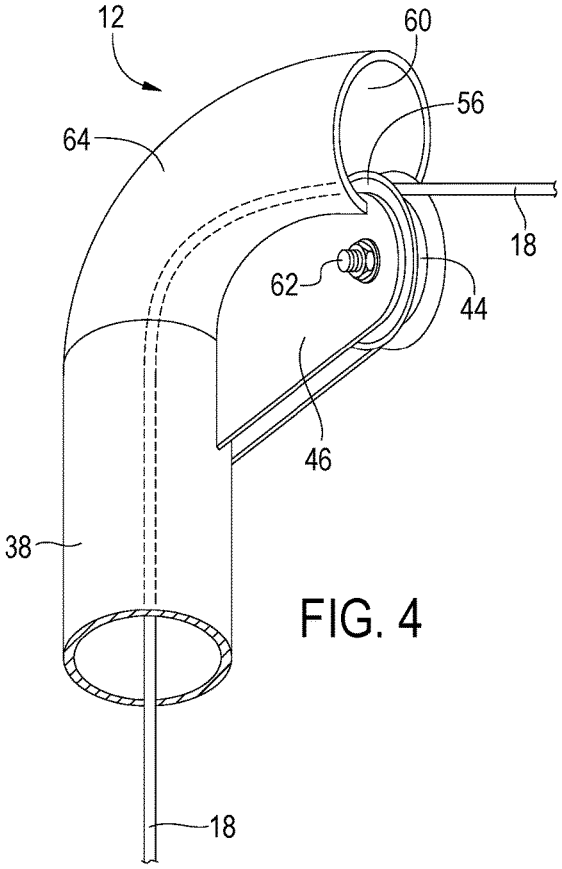
FIG. 4 is a detailed view of a pulley assembly of the gin pole assembly of the present invention.

Turning to FIG. 4, therein is shown an enlarged view of the elbow portion 64 of the gin pole assembly including a portion of the gin pole 38 along with the pulley 44 and the mounting bracket 46 wherein the pulley 44 is attached thereto using a fastener 62, e.g., a nut and bolt as shown herein or the like. It can be seen that the periphery 56 of the pulley extends into the interior 60 of the hollow gin pole assembly 12 so that the load line 18 passes with a minimum amount of friction through the inside of the members of the gin pole assembly 12. The pulley 44 is shown attached to an elbow portion 64 of the gin pole assembly 12.

The present invention 10 is differs from a conventional gin pole for the following reasons: a conventional gin pole is straight and doesn't allow for the effect of the load away from the structure causing additional work maneuvering the equipment into position to complete the work being performed. The present invention 10 has an extension 40 which extends out from the structure 14 allowing the load 22 to remain spaced apart from the structure 4 to 6 feet while being raised or lowered keeping the equipment from being installed, decommission, repaired, or replaced in line with the mounts with little to no tag line 34. The tag 34 is an additional rope attached to the load 22 in order to keep the load from coming in contact with the structure 14 or other equipment mounted on the structure. With the equipment, e.g., cellular equipment, being installed at different levels on the structure 14 the present invention 10 allows the work to be completed more efficiently and safer. With the industry technology ever changing, the construction growth moving faster and more demanding, the present invention will enhance the industry construction efforts. The use of the present invention 10 eliminates the need for a crane in most cases. The present invention 10 can be constructed of many types of material including PVC pipe/conduit, aluminum or titanium pipe/conduit, or many other similar materials.

By way of summary and by making reference to FIGS. 1-4, the present invention 10 discloses a method for hoisting a load 22 up a structure 14 using a load line 18, the structure being upright standing and supported on the ground including a) attaching an elongated gin pole 38 having upper and lower ends to the structure so that the gin pole is upright standing and substantially parallel to a longitudinal axis of the structure, wherein the gin pole is hollow thereby having an interior, b) providing an arm 40 having proximal and distal ends, the proximal end being pivotally attached at 58 to the upper end of the gin pole, wherein the arm extends laterally away from the gin pole, wherein the arm is hollow thereby having an interior 60; c) wherein the arm is angularly adjustable with respect to the gin pool; d) providing a brace 42 for supporting the arm, wherein one end of the brace is pivotally connected to the gin pole at 48 and an opposite end of the brace is pivotally connected to the arm at 52; e) disposing a first elbow portion 64 on the upper end of the gin pole and disposing a second elbow portion on the distal end of the arm so as to terminate in a free end, the free end of the second elbow portion having a longitudinal centerline which is substantially parallel to a longitudinal centerline of the gin pole when the arm is disposed perpendicular to the gin pole (as shown in FIGS. 1, 2); f) providing a pair of pulleys 44, wherein one pulley is mounted at 46 on an inside radius of each first and second elbow portion so that a portion 56 of each pulley passes through the inside radius and extends into the interior 60 of each first and second elbow portion; g) providing a load line 18 having first and second ends, wherein the load line passes through the interior of the gin pole and the arm, wherein the load line has the first end connected to a capstan 30 on the ground and the second end connected to the load; and, h) wherein the load line passes over the first and second pulleys so that the load line is disposed in the interior of the gin pole and the arm, wherein the load line is spaces away from an inner surface of the gin pole and the arm. Furthermore, wherein the capstan is mounted onto a trailer hitch 33 of a vehicle 32 and further comprising the step of attaching the gin pole to the structure using a plurality of straps 16; and, wherein the structure is a pole or wherein the structure is a tower 15. Furthermore, including the step of providing a tag line 34 having one end connected to the load and a second end held by a person 36 on the ground and providing a heel block 24 being attached to a lower end of the structure, wherein the load line passes through the heel block and wherein the first and second elbow portions are ninety degree elbow portions and wherein the arm is angularly adjustable between an angle being perpendicular with respect to the gin pole to an angle of about forty-five degrees with respect to the gin pole.

I claim:

1. A system for hoisting a load up a structure using a load line the structure being upright standing and supported on the ground, comprising:

a) a gin pole, wherein said gin pole is elongated having upper and lower ends being attached to the structure so that said gin pole is upright standing and being substantially parallel to a longitudinal axis of the structure, wherein said gin pole is hollow thereby having an interior;

b) an arm having proximal and distal ends, said proximal end being pivotally attached to said upper end of said gin pole, wherein said arm extends laterally away from said gin pole, wherein said arm is hollow thereby having an interior;

c) wherein said arm is angularly adjustable with respect to said gin pole;

d) a brace for supporting said arm, wherein one end of said brace is pivotally connected to said gin pole and an opposite end of said brace is pivotally connected to said arm;

e) a first elbow portion being disposed on said upper end of said gin pole, a second elbow portion being disposed on said distal end of said arm so as to terminate in a free end, said free end of said second elbow portion having a longitudinal centerline which is substantially parallel to a longitudinal centerline of said gin pole;

f) a first and second pulley, wherein one said pulley is mounted on an inside radius of each said first and second elbow portions so that a portion of each said pulley passes through said inside radius and extends into said interior of each said first and second elbow portion;

g) said load line having first and second ends, wherein said load line passes through said interior of said gin pole and said arm, wherein said load line has said first and connected to a capstan on the ground and said second end connected to the load; and h) wherein said load line passes over said first and second pulleys so that said load line is disposed in said interior of said gin pole and said arm, wherein said load line is spaced away from an inner surface of said gin pole and said arm.

2. The system of claim 1, wherein said capstan is mounted onto a trailer hitch of a vehicle.

3. The system of claim 1, further comprising a plurality of straps for attaching said gin pole to said structure.

4. The system of claim 1, wherein the structure is a pole.

5. The system of claim 1, wherein the structure is a tower.

6. The system of claim 1, further comprising a tag line having one end connected to said load and a second end held by a person on the ground.

7. The system of claim 1, further comprising a heel block being attached to a lower end of the structure, wherein said load line passes through said heel block.

8. The system of claim 1, wherein said first and second elbow portions are ninety degree elbow portions.

9. The system of claim 1, wherein said arm is angularly adjustable between an angle being perpendicular with respect to said gin pole to an angle of about forty-five degrees with respect to said gin pole.

10. A method for hoisting a load up a structure using a load line, the structure being upright standing and supported on the ground, comprising the steps of:

a) attaching a gin pole to the structure, wherein the gin pole is elongated having upper and lower ends so that the gin pole is upright standing and substantially parallel to a longitudinal axis of the structure, wherein the gin pole is hollow thereby having an interior;

b) providing an arm having proximal and distal ends, the proximal end being pivotally attached to the upper end of the gin pole, wherein the arm extends laterally away from the gin pole, wherein the arm is hollow thereby having an interior;

c) wherein the arm is angularly adjustable with respect to the gin pole;

d) providing a brace for supporting the arm, wherein one end of the brace is pivotally connected to the gin pole and an opposite end of the brace is pivotally connected to the arm;

e) disposing a first elbow portion on the upper end of the gin pole and disposing a second elbow portion on the distal end of the arm so as to terminate in a free end, the free end of the second elbow portion having a longitudinal centerline which is substantially parallel to a longitudinal centerline of the gin pole when the arm is disposed perpendicular to the gin pole;

f) providing first and second pulleys, wherein one pulley is mounted on an inside radius of each first and second elbow portion so that a portion of each pulley passes through the inside radius and extends into the interior of each first and second elbow portion;

g) wherein the load line has first and second ends, wherein the load line passes through the interior of the gin pole and the arm, wherein the load line has the first end connected to a capstan on the ground and the second end connected to the load; and h) wherein the load line passes over the first and second pulleys so that the load line is disposed in the interior of the gin pole and the arm, wherein the load line is spaces away from an inner surface of the gin pole and the arm.

11. The method of claim 10, wherein the capstan is mounted onto a trailer hitch of a vehicle.

12. The method of claim 10, further comprising the step of attaching the gin pole to the structure using a plurality of straps.

13. The method of claim 10, wherein the structure is a pole.

14. The method of claim 10, wherein the structure is a tower.

15. The method of claim 10, further comprising the step of providing a tag line having one end connected to the load and a second end held by a person on the ground.

16. The method of claim 10, further comprising the step of providing a heel block being attached to a lower end of the structure, wherein the load line passes through the heel block.

17. The method of claim 10, wherein the first and second elbow portions are ninety degree elbow portions.

18. The method of claim 10, wherein the arm is angularly adjustable between an angle being perpendicular with respect to the gin pole to an angle of about forty-five degrees with respect to the gin pole.

* * * * *